US009309034B2

(12) United States Patent
Paredes et al.

(10) Patent No.: US 9,309,034 B2
(45) Date of Patent: Apr. 12, 2016

(54) DISPENSING CARTON

(71) Applicant: Owens-Brockway Glass Container Inc., Perrysburg, OH (US)

(72) Inventors: Raul M Paredes, Perrysburg, OH (US); David J Bohman, Cincinnati, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 69 days.

(21) Appl. No.: 14/035,182

(22) Filed: Sep. 24, 2013

(65) Prior Publication Data

US 2015/0083624 A1 Mar. 26, 2015

(51) Int. Cl.
*A45C 5/00* (2006.01)
*B65D 71/36* (2006.01)

(52) U.S. Cl.
CPC ..... *B65D 71/36* (2013.01); *B65D 2571/0066* (2013.01); *B65D 2571/00141* (2013.01); *B65D 2571/00339* (2013.01); *B65D 2571/00475* (2013.01); *B65D 2571/00586* (2013.01); *B65D 2571/00728* (2013.01); *B65D 2571/00851* (2013.01); *B65D 2571/00864* (2013.01)

(58) Field of Classification Search
USPC ..... 229/122.1, 121, 242, 103; 206/749, 206/427; 221/302, 305
See application file for complete search history.

(56) References Cited

U.S. PATENT DOCUMENTS 2,126,407 A * 8/1938 Payne et al. ..... 206/750
2,410,615 A * 11/1946 Tucker ..... 206/750
2,804,254 A 8/1957 Ness
3,002,613 A 10/1961 Merkel et al.
3,114,474 A 12/1963 Davis
3,246,796 A 4/1966 Englander et al.
3,474,949 A * 10/1969 Shine ..... 229/117.13
3,677,458 A * 7/1972 Gosling ..... 229/120.011
4,256,223 A 3/1981 Pawlowski
4,375,258 A * 3/1983 Crayne et al. ..... 206/141
4,398,636 A 8/1983 Baxter
4,452,367 A * 6/1984 Wein ..... 229/101

(Continued)

FOREIGN PATENT DOCUMENTS

DE 20212076 U1 11/2002
DE 102008015079 10/2009

(Continued)

OTHER PUBLICATIONS

PCT International Search Report and Written Opinion, Int. Serial No. PCT/US2014/054056, Int. Filing Date: Sep. 4, 2014, Applicant: Owens-Brockway Glass Container Inc., Mail Date: Nov. 19, 2014.

*Primary Examiner* — Jacob K Ackun

(57) ABSTRACT

A carton for multiple containers having a height HC in which the carton has a bottom panel, a top panel opposite the bottom panel, a front panel, a back panel, and first and second opposed end panels that form a closed carton. The carton has a transport orientation with the carton resting on the bottom panel such that containers are supportable on their ends in an upright position. The carton has a first dispensing configuration in which the carton is restable on one of the front and back panels and the containers are restable on their sides. A hinge on the bottom panel divides the bottom panel into two bottom panel portions. With the carton in the first dispensing configuration, the two bottom panel portions are in a common plane and the hinge is oriented in the vertical direction.

10 Claims, 5 Drawing Sheets

(56) References Cited

U.S. PATENT DOCUMENTS

| | | | | | |
|---|---|---|---|---|---|
| 5,181,650 | A | * | 1/1993 | Hollander et al. | 206/746 |
| 5,261,533 | A | * | 11/1993 | Adams et al. | 206/261 |
| 5,368,194 | A | | 11/1994 | Oliff et al. | |
| 5,699,957 | A | | 12/1997 | Blin et al. | |
| 5,722,583 | A | | 3/1998 | Focke et al. | |
| 5,857,570 | A | | 1/1999 | Brown | |
| 5,921,398 | A | | 7/1999 | Carroll | |
| 6,129,211 | A | * | 10/2000 | Prakken et al. | 206/750 |
| 6,189,778 | B1 | | 2/2001 | Kanter | |
| 6,523,692 | B2 | | 2/2003 | Gregory | |
| 6,869,009 | B2 | | 3/2005 | Sutherland et al. | |
| 6,913,189 | B2 | | 7/2005 | Oliff et al. | |
| 6,991,107 | B2 | | 1/2006 | Harrelson | |
| 7,048,817 | B1 | | 5/2006 | Hammond | |
| 7,059,494 | B2 | | 6/2006 | Harrelson et al. | |
| 7,225,930 | B2 | | 6/2007 | Ford et al. | |
| 7,475,777 | B2 | | 1/2009 | Fung et al. | |
| 7,648,048 | B2 | | 1/2010 | Smith | |
| 7,743,944 | B2 | | 6/2010 | Ho Fung et al. | |
| 7,743,972 | B2 | | 6/2010 | Fogle | |
| 7,766,219 | B2 | * | 8/2010 | Gomes et al. | 229/122 |
| 7,780,003 | B2 | | 8/2010 | Harrelson | |
| 8,033,449 | B2 | | 10/2011 | Ho Fung et al. | |
| 8,127,924 | B2 | | 3/2012 | Harrelson | |
| 8,181,782 | B2 | | 5/2012 | Harrelson | |
| 2001/0001447 | A1 | | 5/2001 | Gregory | |
| 2002/0070145 | A1 | | 6/2002 | Yuhas et al. | |
| 2002/0170845 | A1 | | 11/2002 | Oliff | |
| 2003/0213263 | A1 | | 11/2003 | Woog | |
| 2004/0188277 | A1 | * | 9/2004 | Auclair | 206/139 |
| 2006/0027639 | A1 | | 2/2006 | Rasmussen | |
| 2006/0249529 | A1 | | 11/2006 | Smalley et al. | |
| 2006/0254942 | A1 | * | 11/2006 | Cargile, Jr. | 206/427 |
| 2007/0227823 | A1 | | 10/2007 | Frohwein | |
| 2007/0295793 | A1 | | 12/2007 | Ho Fung et al. | |
| 2010/0224675 | A1 | * | 9/2010 | Bell et al. | 229/103 |
| 2013/0105355 | A1 | * | 5/2013 | Keefe | 206/736 |

FOREIGN PATENT DOCUMENTS

| | | | |
|---|---|---|---|
| EP | 2221254 | A1 | 8/2010 |
| EP | 2581319 | A1 | 4/2013 |

* cited by examiner

DISPENSING CARTON

The present disclosure is directed to a secondary packaging carton for beverage containers, and more particularly, to a packaging carton which is convertible into two dispensing configurations for refrigerator storage and dispensing.

BACKGROUND AND SUMMARY OF THE DISCLOSURE

A general object of the present disclosure, in accordance with one aspect of the disclosure, is to provide a secondary packaging carton for beverage containers that is convertible into two dispensing configurations for refrigerator storage and dispensing.

The present disclosure embodies a number of aspects that can be implemented separately from or in combination with each other.

A secondary packaging carton in accordance with one aspect of the disclosure includes a carton in which the beverage containers within are upright, standing on end for marketing purposes and transport from a place of purchase to the purchaser's home.

In accordance with another aspect of the disclosure, there is provided a secondary packaging carton which may be oriented in a first dispensing configuration to place the beverage containers on their side, and which has two tear away corners for dispensing the beverage containers while supported on a main shelf of a refrigerator.

In accordance with another aspect of the disclosure, there is provided a secondary packaging carton having two hinged sub-cartons that may be fanned apart to configure the carton in a second dispensing configuration for placement on a door shelf of a refrigerator.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION

Figure 1:
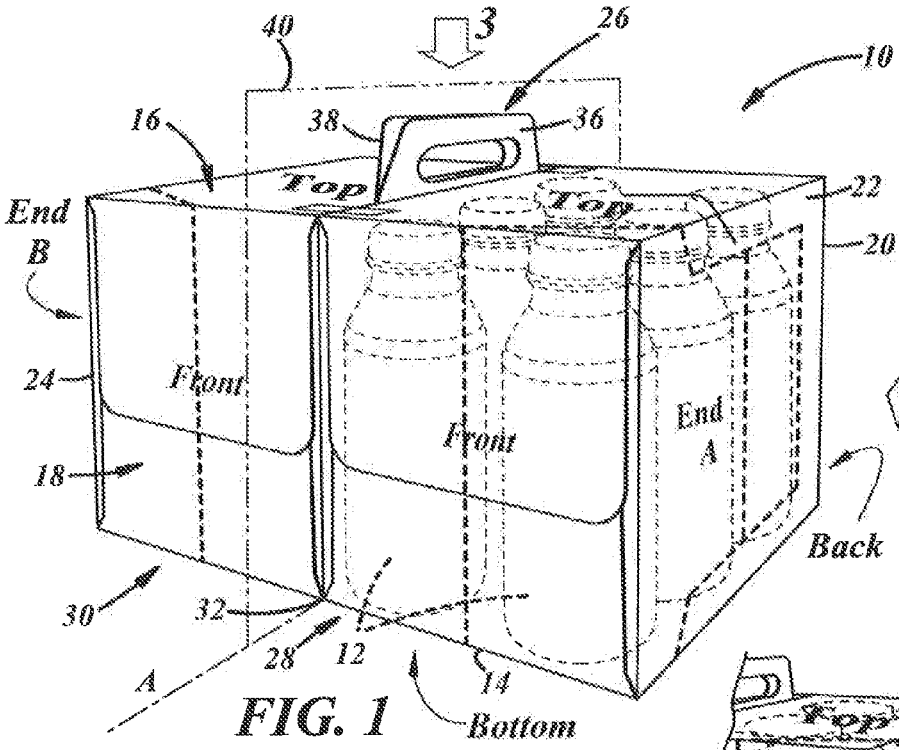
FIG. 1 is a perspective view of a convertible secondary packaging carton for beverage containers in accordance with an illustrative embodiment of the present disclosure.
Figure 1A:
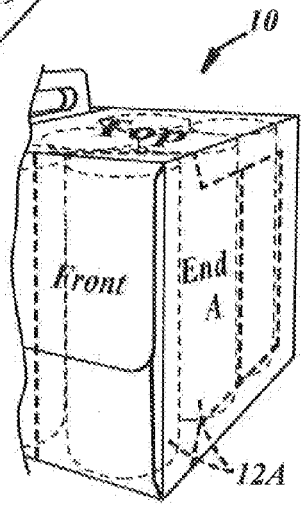
FIG. 1A is a partial perspective view of the carton of FIG. 1 having cans instead of bottles within the carton.

Turning now to the drawing figures, FIG. 1 shows a secondary packaging carton 10 generally designated by the reference numeral 10 for beverage containers 12. The beverage containers 12 may be bottles, as shown, or cans, as shown in FIG. 1A, or jars or any other suitable container. The carton 10 has a closed shape with a bottom panel 14, a top panel 16, a front panel 18, a back panel 20, and two end panels 22 and 24. The carton 10 is shown in a transport orientation resting on the bottom panel 14. The beverage containers 12 in the carton 10 are supported on their ends in an upright position for stability and safety, and a handle 26 facilitates transport of the carton 10 from the place of purchase to the purchaser's home. The handle 26 is positioned adjacent to the top panel 16 of the carton 10, and may be initially folded flat against the top panel 16 for stacking purposes prior to sale. The handle 26 comprises two mirror image handle portions 36 and 38, each portion being integral with or otherwise joined to one of two sub-cartons 28 and 30 as explained more fully below.

Figure 8:
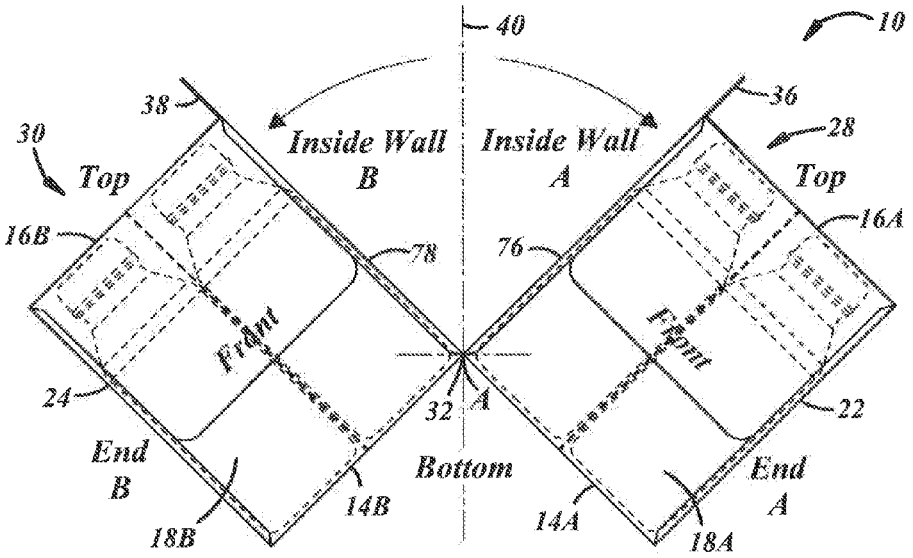
FIG. 8 is a front view of the carton of FIG. 1 partially fanned apart to reduce the depth of the carton so that it can be stored on a door shelf of a refrigerator.
Figure 9:
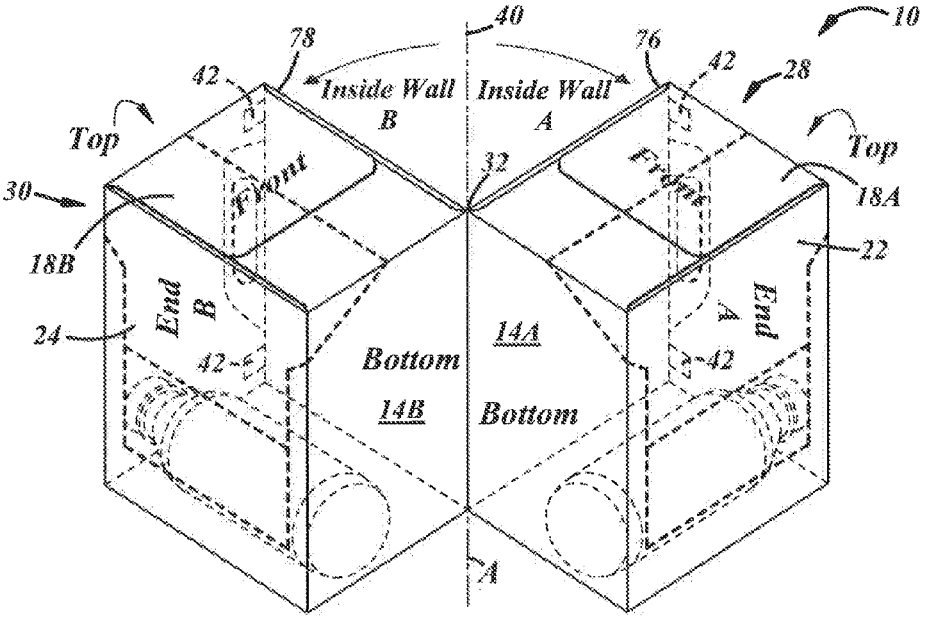
FIG. 9 is a perspective view of the carton of FIG. 8.
Figure 12:
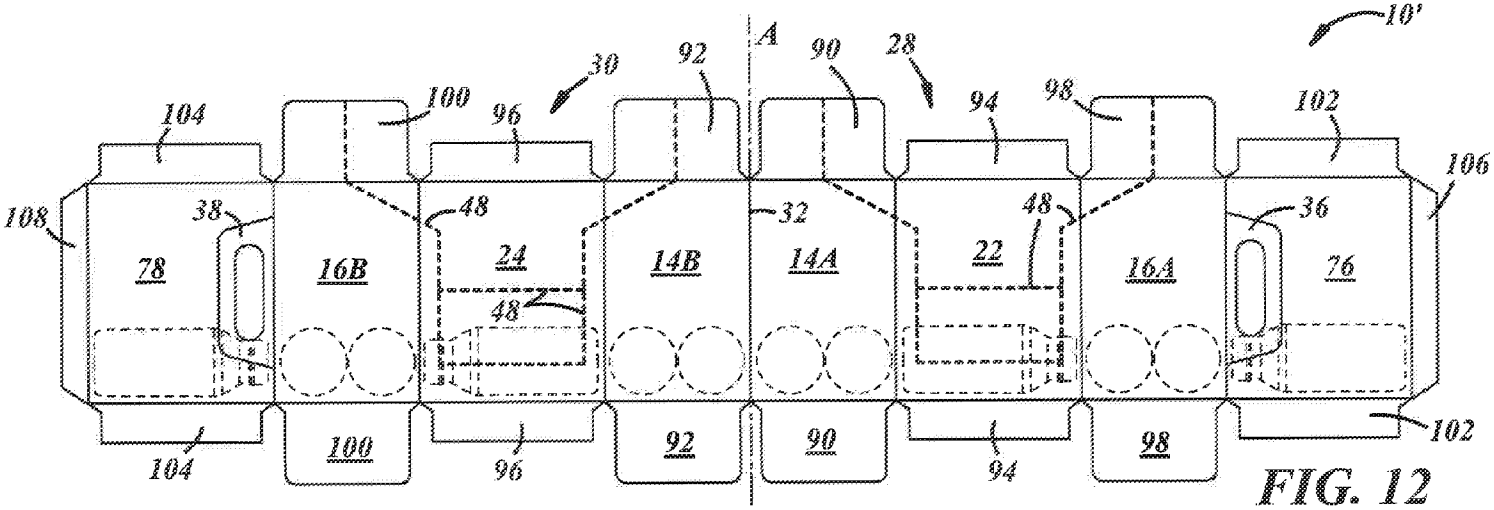
FIG. 12 is a blank for forming the carton shown in FIGS. 1-11.

The carton 10 comprises the side-by-side first and second sub-cartons 28 and 30, respectfully, that are positioned on either side of a separation plane 40. The sub-cartons 28 and 30 are joined together by a hinge 32 located on the bottom panel 14, on the opposite side of the carton 10 from the handle 26. The length dimension of the hinge 32 is parallel to the length dimension of the handle 26, and with the carton 10 supported on the bottom panel 14 in the position shown, the hinge 32 extends horizontally. The hinge 32 may be formed integrally with the material forming the sub-cartons 28 and 30 as best seen in FIGS. 8, 9 and 12, and explained more fully below.

FIG. 1A is a partial perspective view of the carton 10 of FIG. 1 showing the beverage containers 12A within the carton 10 comprising cans instead of bottles as shown in FIGS. 1 and 2-12.

Figure 2:
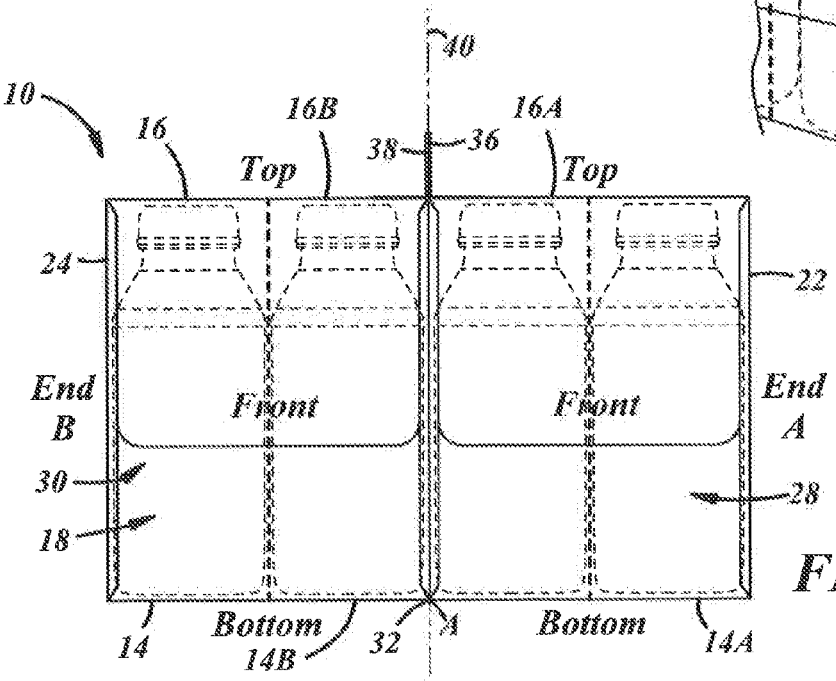
FIG. 2 is a front view of the carton of FIG. 1.

FIG. 2 is a front view of the carton 10 of FIG. 1 resting on the bottom panel 14. The two sub-cartons 28, 30 are separated from one another by the separation plane 40 that divides the carton 10 into two halves. The separation plane 40 contains the hinge 32, and the two handle portions 36 and 38 are located on either side of the separation plane 40. The separation plane 40 divides the bottom panel 14 of the carton 10 into bottom panel portions 14A and 14B, and the top panel 16 of the carton 10 into top panel portions 16A and 16B. With the carton 10 in this orientation, the bottom panel 14 is horizontal, and the bottom panel portions 14A and 14B are in a common plane.

Figure 3:
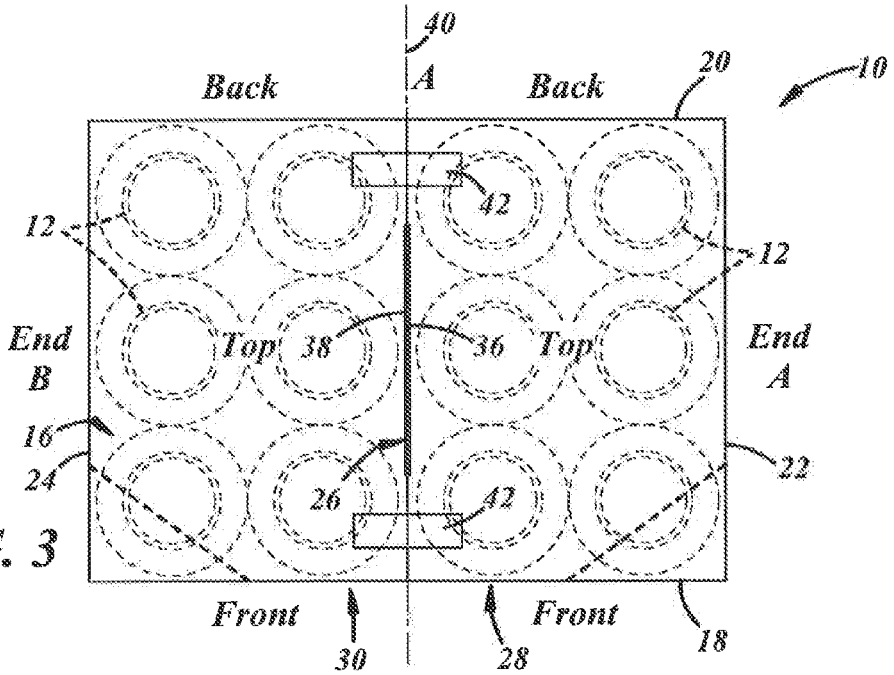
FIG. 3 is a top view of the carton of FIG. 1 taken in the direction of the arrow 3 in FIG. 1.

FIG. 3 is a top view of the carton 10 of FIG. 1 taken in the direction of the arrow 3 in FIG. 1. Two or more seal strips 42 adjacent either end of the handle 26 span the separation plane 40 between the two sub-cartons 28 and 30, and hold the sub-cartons 28 and 30 and the two handle portions 36 and 38 next to one another. The seal strips 42 may be formed from adhesive tape, or cardboard with an adhesive coating on one side thereof, or the like.

Figure 4:
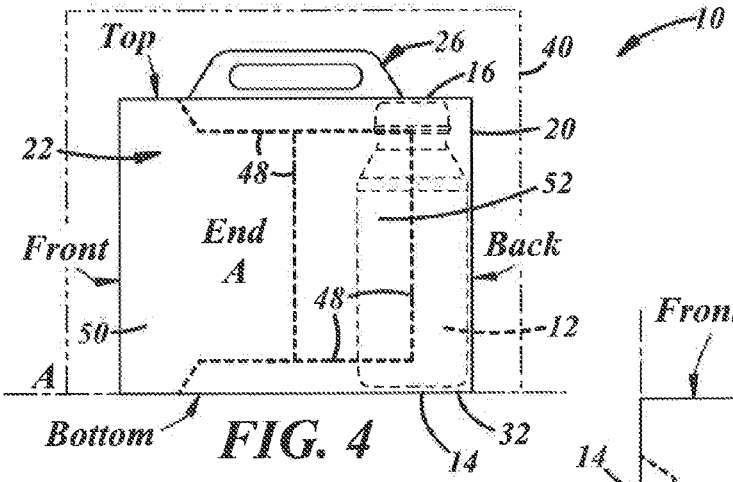
FIG. 4 is an end view of the carton of FIG. 1 taken in the direction of the arrow 4 in FIG. 1.

FIG. 4 is an end view of the carton 10 of FIG. 1 taken in the direction of the arrow 4 in FIG. 1. The carton 10 is resting on the bottom panel 14. The carton 10 has weakenings 48 to form a plurality of removable tear-out access panels 50 and 52 that are connected to other panels forming the carton 10 and to one another. The weakenings 48 may be formed in the carton material, for instance, by pre-scoring, perforations, thinning, and the like. The tear out access panels 50 and 52 can be removed in sequence as containers 12 are removed from the carton 10 to provide access to the containers that are in the carton 10 as explained in greater detail below.

Figure 5:
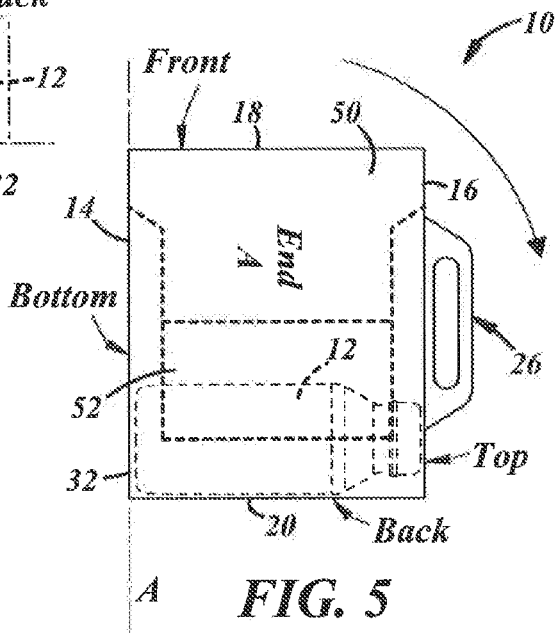
FIG. 5 shows the carton of FIG. 4 rotated ninety degrees around a horizontal axis so that the carton can be supported on its back.

FIG. 5 shows the carton 10 of FIG. 4 rotated ninety degrees about a horizontal axis into a first dispensing configuration, with the bottom panel 14 now in a vertical plane, and the hinge 32 extending vertically. With the carton 10 in the first dispensing configuration, the top panel 16 of the carton 10 and the handle 26 are located in a vertical plane on one side of the carton 10, the hinge 32 is located on the opposite side of the carton 10, and the beverage containers 12 are in a horizontal position.

Figure 6:
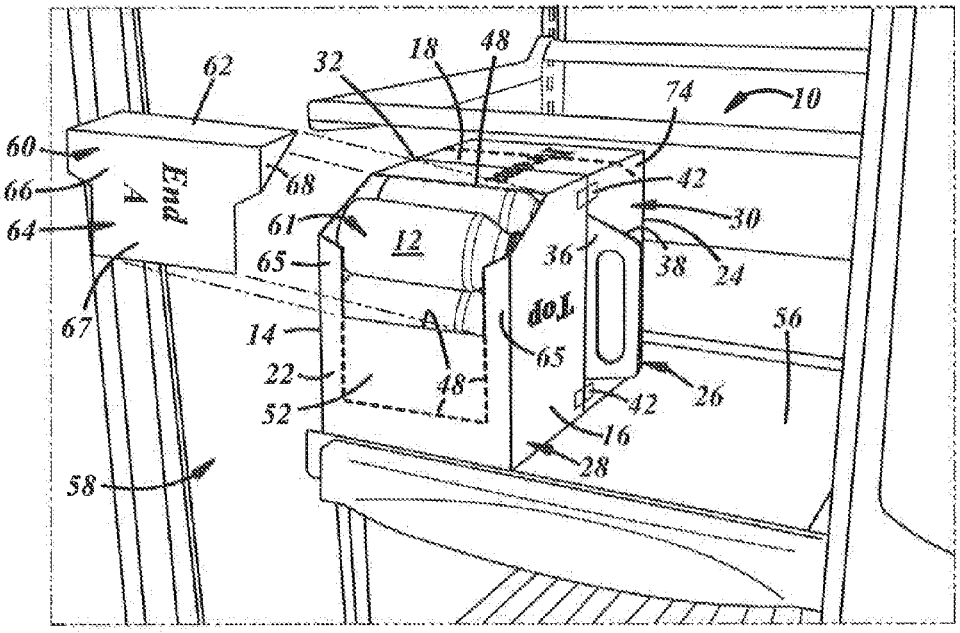
FIG. 6 is a perspective view of the carton of FIG. 5 supported on a main refrigerator shelf with the top corner of the near end torn away to provide a dispensing opening on the carton.

FIG. 6 is a perspective view of the carton 10 of FIG. 5 in the first dispensing configuration on a main shelf 56 of a refrigerator 58. With the carton 10 in the first dispensing configuration, the hinge 32 and the handle 26 are on opposite sides of the carton 10, the two handle portions 36 and 38 are together, the beverage containers 12 are lying on their sides, and first and second dispensing openings may be made in the first and second sub-cartons 28 and 30 as described more fully below.

A first tear-away corner 60 on the first sub-carton 28 has been torn away along the weakenings 48 to form a first dispensing opening 61 for the beverage containers 12 in the first sub-carton 28. The first tear-away corner 60 includes a top portion 62 taken from the front panel 18 and extends from the top panel 16 to the bottom panel 14 of the carton 10, and a front portion 64 that is taken from the end panel 22 of the carton 10. The front portion 64 of the tear away corner 60 has an upper portion 66 that extends across the full width of the end panel 22, and a lower portion 67 that extends across less than the full width of the end panel 22. The first tear-away corner 60 may also include corner portions 68 (only one shown) which are taken from the top panel 16 and bottom panel 14 of the carton 10.

Figure 7:
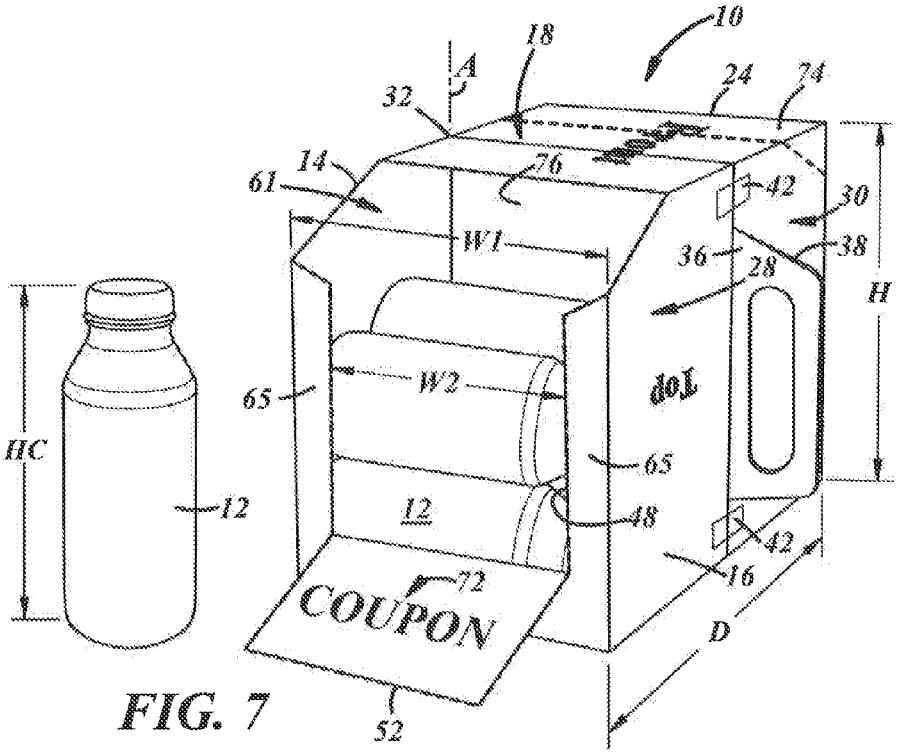
FIG. 7 is a perspective view of the carton of FIG. 5 having the upper tear-away corner removed and the lower tear-away panel broken out.

With reference to FIG. 7, the first dispensing opening 61 allows the containers 12 within the carton 10 to be removed from a top of the dispensing opening 61 without twisting the containers or tearing the carton 10. The width of the lower portion 67 of the tear away corner 60 (as shown in FIG. 6) leaves side retainer portions 65 on either side of the dispensing opening 61. The side retainer portions 65 reduce the width of the dispensing opening 61 to less than the height HC of a container 12, and keep the containers from spilling out of the dispensing opening 61. A lower removable panel 52 may be formed by weakenings 48 below the lower portion 67 of the first tear-away corner 60. A second tear-away corner 74 is provided on the opposite end 24 of the carton 10, on the second sub-carton 30. Removing the second tear-away corner 74 forms a second dispensing opening on the second sub-carton 30 that is similar in size and shape to the first dispensing opening 61 formed in the first sub-carton 28.

As shown in FIG. 6, the carton 10 may be oriented on the main shelf 56 so that the first tear-away corner 60 on the first sub-carton 28 faces the front of the refrigerator 58. When the first sub-carton 28 facing the front of the refrigerator 58 is empty, the carton 10 is repositioned by rotating it one hundred and eighty degrees around a vertical axis so that the second tear-away corner 74 on the second sub-carton 30 faces the front of the refrigerator 58. After the second tear-away corner 74 has been removed, the beverage containers 12 may be removed from the second sub-carton 30 through the second dispensing opening (not shown) that is formed.

FIG. 7 is a perspective view of the carton 10 of FIG. 5 having the upper tear-away corner 60 as shown in FIG. 6 removed, and the lower tear-away panel 52 broken out. Removing the lower removable panel 52 facilitates access to lower containers 12 remaining in the carton 10 after the upper containers have been removed. Indicia 72 may be used on the inside surface of the lower removable panel 52 to provide a message to the user, or to provide a coupon for subsequent purchases. FIG. 7 also shows the relative dimensions of the carton 10 and the containers 12 that are held by the carton 10. The containers 12 have a height HC, and although a container in the form of a bottle is shown, the container 12 may also comprise a can as shown in FIG. 1A. The inside width of the dispensing opening 61 measured between the top 16 and the bottom 14 of the carton 10 is W1, and W1 is at least as great as the height HC of the container 12. The width of the dispensing opening 61 formed between the side retainer portions 65 is W2. The width W2 is less than W1, and less than the height HC of the containers 12 in order to prevent the containers 12 from spilling out of the dispensing opening 65. As shown, the dimension H of the carton 10 is about equal to a multiple of the diameter of the containers 12, and the dimension D of the carton 10 is about equal to a multiple of the diameter of the containers 12. In the example shown, the dimension H is roughly equal to three container diameters, and the dimension D is roughly equal to four container diameters. In the example shown, the carton 10 holds twelve containers 12, although the carton 10 may be dimensioned to hold a fewer or greater number of containers 12 as desired.

FIG. 8 is a front view and FIG. 9 is a perspective view of the convertible refrigerator carton 10 of FIG. 1 with the two sub-cartons 28 and 30 partially fanned apart so that the carton 10 can be put into a second dispensing configuration. In order to fan the two-sub-cartons 28 and 30 apart, the seal strips 42 may be severed or removed to permit the two sub-cartons 28 and 30 to swing away from one another around the axis A of the hinge 32. Fanning the two sub-cartons 28 and 30 apart separates the two inside wall panels 76 and 78 of the two sub-cartons 28 and 30, respectively, and also separates the two handle portions 36 and 38. Prior to fanning the two sub-cartons 28 and 30 apart, the two bottom panel portions 14A and 14B are in a common plane, and the two inside wall panels 76 and 78 are in parallel planes.

Figure 10:
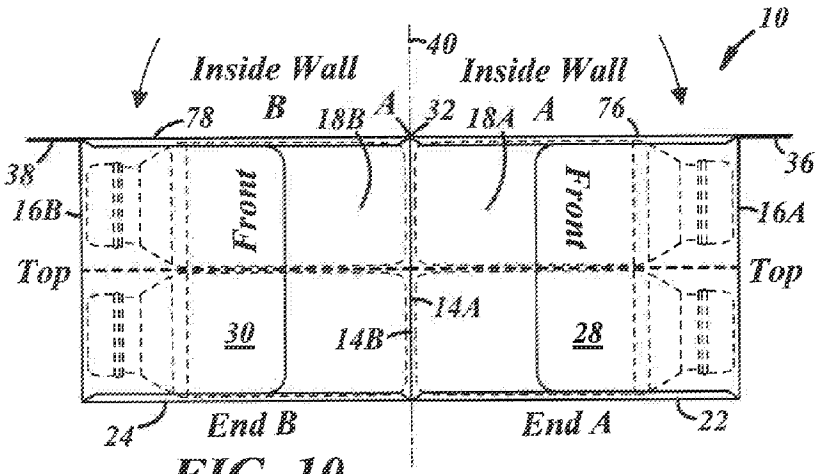
FIG. 10 is a front view of the carton of FIG. 8 after it is fully fanned apart.

FIG. 10 is a front view of the carton 10 of FIGS. 8 and 9 with the two sub-cartons 28 and 30 fully fanned out into a second dispensing configuration so that the inside wall panels 76 and 78 now lie in a common plane divided by the hinge 32, and the two bottom panel portions 14A and 14B are in parallel planes. The original top panel 16 of the carton 10 is now divided into two top panel portions 16A and 1613 that are on opposite sides of the carton 10, and the two end panels 22 and 24 of the carton 10 are opposite the inside wall panels 76 and 78. The front panel 18 of the carton 10 is divided into two front panel portions 18A and 18B, and the bottom panel 14 of the carton 10 is divided into two bottom panel portions 14A and 14B that lie in parallel planes, and face one another. The handle portions 36 and 38 are on opposite ends of the carton 10.

Figure 11:
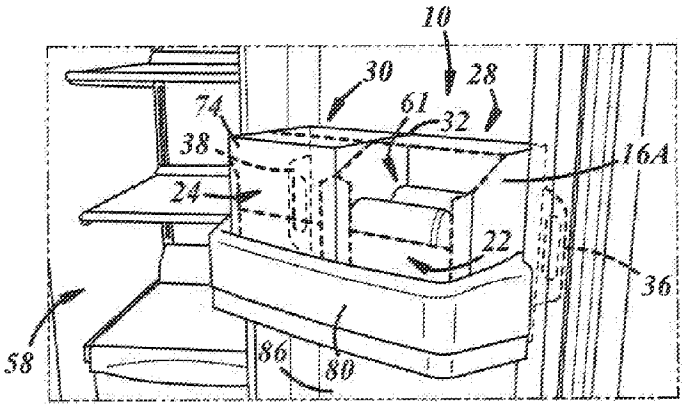
FIG. 11 is a perspective view of the carton of FIG. 10 fully fanned apart and positioned on a refrigerator door shelf with one of the corners torn off for dispensing beverage containers.

FIG. 11 is a perspective view of the carton 10 of FIG. 10 with the sub-cartons 28 and 30 fully fanned apart into the second dispensing configuration and rotated ninety degrees about a horizontal axis and positioned on the door shelf 80 of a refrigerator 58. The two ends 22 and 24 of the carton 10 face outward from the refrigerator door. The first tear away corner 60 shown in FIG. 6 has been torn off to create a first dispensing opening 61 for dispensing beverage containers 12 from the door shelf 80 of the refrigerator 58. Since both the first tear away corner 60 and the second 74 tear-away corners are on the same side of the carton 10, and face outward from the refrigerator door 86, the second tear-away corner 74 may be torn off without repositioning the carton 10 on the refrigerator door shelf 80. Fanning the two sub-cartons 28 and 30 into the second dispensing configuration as shown in FIG. 11 reduces the depth of the resulting carton 10 by one half, and increases the width of the second carton dispensing configuration by a factor of two compared to the depth and width dimensions of the carton 10 in the first dispensing configuration as shown in FIGS. 6 and 7. With the carton 10 in this second dispensing configuration, the two handle portions 36 and 38 are separated from one another on opposite ends of one side of the carton 10, the hinge 32 extends vertically on the back of the carton 10, and the handle portions 36 and 38 are on the same side of the carton 10.

FIG. 12 is a blank 10□ for forming the carton 10 of FIGS. 1-11. The hinge 32 is formed in the center of the blank 10□. The hinge 32 may be pre-creased to facilitate bending the blank 10□ along the hinge to fan out the sub-cartons 28 and 30 for later use as shown in FIGS. 8-11. The first and second bottom panel portions 14A and 14B are located on either side of the hinge 32, and will form the bottom panel 14 of the carton 10 in its storage and marketing position as shown in FIGS. 1-4. First and second end panels 22 and 24 are foldably connected one each to the first and second bottom panel portions 14A and 14B, respectively, and first and second top panels 16A and 16B are foldably connected one each to the first and second end panels 22 and 24, respectively. First and second inside wall panels 76 and 78 are foldably connected one each to the first and second top panel portions 16A and 16B, respectively. The handle portions 36 and 38 may be cut out and integrally formed from each of the first and second inside panels 76 and 78, respectively. Integrally forming the handle portions 36 and 38 from the inside wall panels 76 and 78 eliminates the need to glue or otherwise fasten the handle portions 36 and 38 to the body of the carton 10, and will result in a strong attachment between the handle portions 36 and 38 and the carton 10.

First and second bottom panel flaps 90 and 92 are integrally formed on both ends of the first and second bottom panel portions 14A and 1413, respectively, and are foldably connected thereto. First and second side panel flaps 94 and 96 are integrally formed on both ends of the first and second side panels 22 and 24, respectively, and are foldably connected thereto. First and second top panel flaps 98 and 100, are integrally formed on both ends of the first and second top panel portions 16A and 16B, respectively, and are foldably connected thereto. First and second inside panel flaps 102 and 104 are integrally farmed on both ends of the first and second inside wall panels 76 and 78, respectively, and are foldably connected thereto. First and second bottom panel glue flaps 106 and 108 are integrally formed on the sides of the first and second inside wall panels 76 and 78, respectively, and are foldably connected thereto.

When the blank 10□ is folded into its final shape to form the carton 10, the bottom panel flaps 90 and 92, the side panel flaps 94 and 96, the top panel flaps 98 and 100, and the inside panel flaps 102 and 104 are adhered to one another to form and enclose the ends of the sub-cartons 28 and 30. The bottom panel glue flaps 106 and 108 secure the inside wall panels 76 and 78, respectively, to the bottom panels 14A and 14B respectively, and complete the formation of the sub-cartons 28 and 30.

There thus has been disclosed a secondary packing carton for beverage containers that fully satisfies one or more of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. For example, the subject matter of each of the embodiments is hereby incorporated by reference into each of the other embodiments, for expedience. The disclosure is intended to embrace all such modifications and variations as fall within the spirit and broad scope of the appended claims.

The invention claimed is:

1. A carton for multiple beverage containers having a height HC, the carton comprising:

a bottom panel, a top panel opposite the bottom panel, a front panel, a back panel, and first and second opposed end panels, wherein the panels form a closed carton;

a transport orientation for the carton wherein the carton is restable on the bottom panel and containers are supportable on their ends in an upright position within the carton;

a first dispensing configuration for the carton wherein the carton is restable on one of either the front or the back panels and the containers are restable on their sides;

a hinge on the bottom panel and dividing the bottom panel into two bottom panel portions, wherein with the carton in the first dispensing configuration and the two bottom panel portions are in a common plane and the hinge is oriented in the vertical direction; and a first tear away corner for dispensing the containers with the carton in a first dispensing configuration, the first tear away corner having a front portion formed from a portion of the first of the opposed end panels and also having a top portion extending from the top panel to the bottom panel.

2. The carton of claim 1 further comprising:

two inside wall panels dividing the carton into two sub-cartons, a first dispensing opening in the first sub-carton and a second dispensing opening in the second sub-carton.

3. The carton of claim 2 wherein removal of the first tear away corner forms the first dispensing opening in the carton that has a width W1 that is at least as great as the height HC of the containers, and the front portion having a width W2 that is less than the height HC of the containers.

4. The carton of claim 3 further comprising:

a second tear away corner for dispensing the containers within, the second tear away corner having a top portion extending from the top panel to the bottom panel, wherein removal of the second tear away corner forms the second dispensing opening in the carton, and wherein the second tear away corner is on the opposite end of the carton from the first dispensing opening with the carton positioned in the first dispensing configuration.

5. The carton of claim 2 further comprising:

a second dispensing configuration for the carton, wherein in the second dispensing configuration the two bottom panel portions are in two parallel planes facing one another and the first and second dispensing openings are on the same side of the carton.

6. The carton of claim 5 wherein with the carton in the first dispensing configuration the carton is dimensioned to fit on a main shelf of a refrigerator; and wherein with the carton in the second dispensing configuration, the carton is dimensioned to fit on a door shelf of a refrigerator.

7. The carton of claim 5, wherein with the carton in the second dispensing configuration, a first overall dimension of the carton decreases by one half, and a second overall dimension of the carton doubles compared to the carton in the first dispensing configuration.

8. The carton of claim 1, further comprising:

a handle for transporting the carton, the handle being located on the top panel of the carton, opposite the hinge.

9. The carton of claim 1 further comprising:

a handle for transporting the carton, the handle being located on the top panel of the carton, opposite the hinge, with two handle portions comprising the handle, the two handle portions being attached one each to the inside wall panels of the carton.

10. The carton of claim 9 further comprising:

the two handle portions being side-by side when the carton is in the first dispensing configuration; and, the two handle portions being on opposite ends of the carton when the carton is in the second dispensing configuration.

* * * * *